United States Patent [19]

Donofrio et al.

[11] 4,091,246

[45] May 23, 1978

[54] ENCRYPTION DEVICE INTERLOCK

[75] Inventors: Frank Carl Donofrio, Norristown; Angelo Richard DiPietro, Philadelphia, both of Pa.

[73] Assignee: Burroughs Corporation, Detroit, Mich.

[21] Appl. No.: 781,931

[22] Filed: Mar. 28, 1977

[51] Int. Cl.[2] ..... H01H 9/20

[52] U.S. Cl. ..... 200/50 B; 200/51.09; 339/125 R

[58] Field of Search ..... 200/50 R, 50 A, 50 B, 200/51 R, 51.08, 51.1, 51.16, 51.09; 339/126 R, 125 R, 65, 66 R

[56] References Cited

U.S. PATENT DOCUMENTS 3,598,941 8/1971 Nelson ..... 200/51.09

*Primary Examiner*—Robert K. Schaffer
*Assistant Examiner*—Morris Ginsburg
*Attorney, Agent, or Firm*—Francis A. Varallo; Edmund M. Chung; Kevin R. Peterson

[57] ABSTRACT

Interlock means are described for protecting against the surreptitious entry into, and tampering with security type communication systems. A connector interlock plate is provided which prevents the removal of an access cover on the electronic device cabinet without the first removal of a standard cable connector assembly. Concurrently, removal of the cable assembly actuates an electrical switch which destroys the confidential information being stored and processed within the device.

9 Claims, 4 Drawing Figures

ENCRYPTION DEVICE INTERLOCK

BACKGROUND OF THE INVENTION

Electronic data processing and communications equipment is frequently utilized to handle confidential data which is to be kept secret from unauthorized disclosure. The need exists for a simple yet effective means of preventing surreptitious entry into terminal-like devices which house sensitive electronic circuits, keys and codes. Moreover, should physical entry into the device be made, it is essential that the data stored therein be destroyed to prevent the intruder from having access thereto.

The interlock means provided by the present invention fills this security need.

SUMMARY OF THE INVENTION

The present invention finds particular application in secure data communications terminals, although it is not to be considered limited thereto. In such an application, there is provided an input-output cable assembly selected to be interlocked. After being fitted with a special interlock plate, the connector plug of the cable assembly is joined with its mating connector receptacle which is mounted on a board affixed to the terminal back plane. Access to the connector receptacle is had by way of an opening in the cover of the terminal set. This opening is surrounded by an outwardly projecting wall which is preferably formed in one piece with the remainder of the cover. The wall portion encompasses the interlock plate when the latter is operatively positioned, thereby preventing tampering with the perimeter of the interlock plate and its cable assembly.

Installation of the interlock plate and assembly within the cover wall portion, results in the actuation of an electrical switch by means of pressure applied to the switch contact button by the interlock plate. This action completes an electrical circuit which permits an encrypted key or code to be loaded into the terminal. If the cable and interlock plate are removed, the electrical circuit is opened and the key or code destroyed.

In order to prevent the unauthorized removal of the terminal cover to the extent that access to the electrical switch button might be had, the fasteners which hold the cover to the back plane mounting board are located behind the interlock plate. Removal of the cover fasteners, which then permits disassembly of the terminal housing, can only take place if the cable assembly and plate are removed. As noted hereinbefore, this action eradicates the code stored in the terminal.

The terminal housing encloses the top and the sides of the device with the exception of the side enclosed by the access cover. The housing includes tabs at respective side corners thereof which are adjacent to the cover. These tabs cooperate with fasteners in securing the housing to the device. The access cover is formed with inwardly projecting members which obscure the housing fasteners when the cover is in place and prevent the removal thereof.

In summary, a single interlock means in accordance with the present invention prevents access to the interior of the terminal set while the cable assembly is in place, and removal of the assembly destroys the data being stored in the set. These and other features of the invention will become more fully apparent in the detailed description of the interlock means and its mode of operation, which follows.

DESCRIPTION OF THE PREFERRED EMBODIMENT

Figure 1:
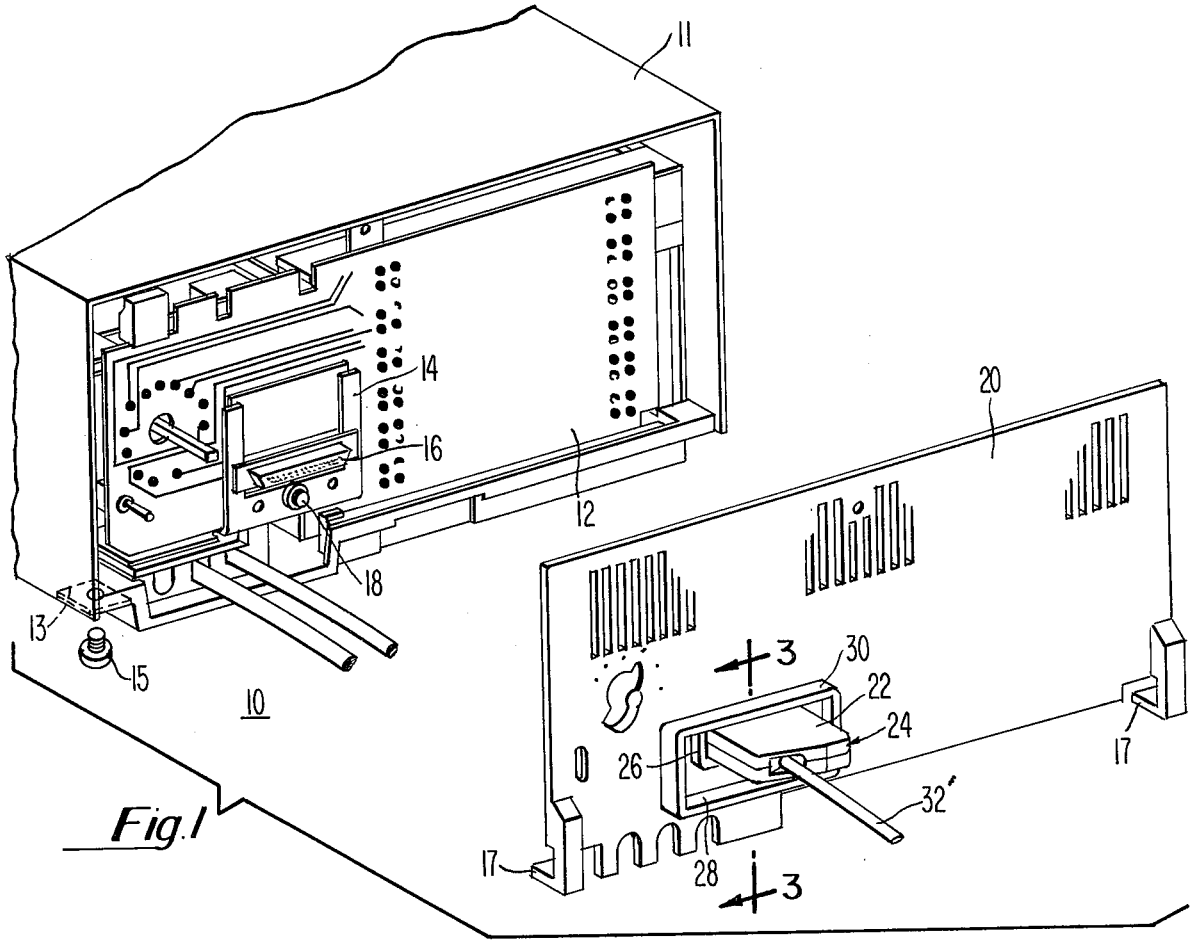
FIG. 1 is an exploded view of an electronic device depicting its housing back plane and access cover with the cable assembly and interlock plate installed in their operative position.

FIG. 1 illustrates in highly simplified form an electronic device 10 such as a data communications terminal. The back plane 12 has affixed thereto a mounting board 14. Fastened to the latter are connector receptacle means 16 and a push button switch 18. The latter is assumed to be connected by electrical conductors between a source of power and memory circuits and registers (not shown) housed within the terminal.

The rear cover 20 which in device operation is mounted in close proximity to the back plane 12 and its mounting board 14 is illustrated. The connector plug 22 of cable assembly 24 is shown fitted within an interlock plate 26, which in turn has been inserted within a well 28 whose sides 30 project outward from the surface of the cover 20. An electrical cable 32' enters the connector 22. The details of the cable assembly 24 and interlock plate 26 are both seen in FIG. 2.

FIG. 1 also depicts a housing 11 for the device 10 which encloses the top and the sides thereof with the exception of the side enclosed by the access cover 20. The housing 11 is formed with a pair of tabs 13 proximately situated at respective side corners thereof which lie adjacent the cover 20 when the latter is in place. Each of the tabs has an opening to accept a screw 15 for securing the housing to the device. The cover 20 is formed with inwardly projecting members 17 which obscure the screws 15 and prevent their removal when the cover is operatively positioned.

Figure 3:
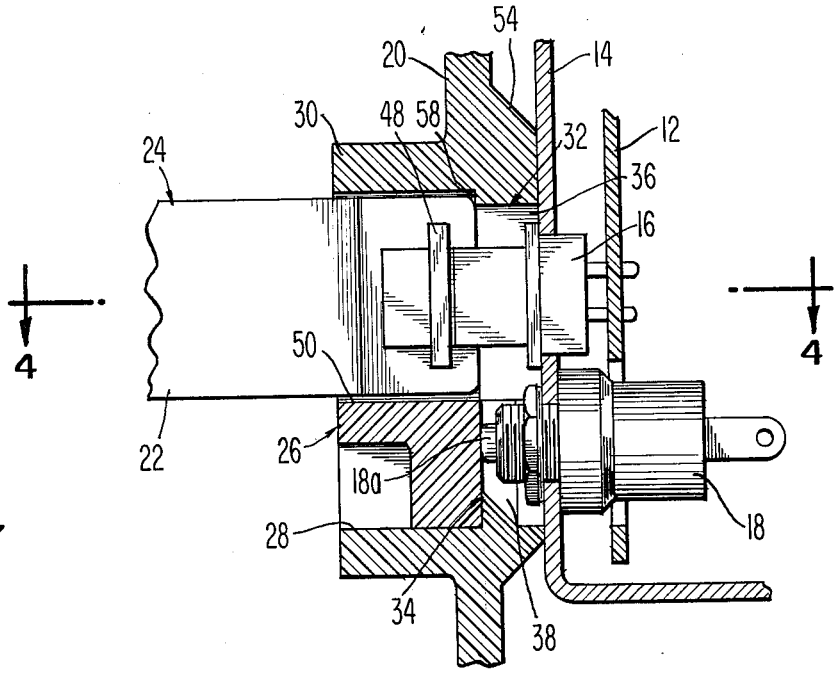
FIG. 3 is a section view taken along the lines 3—3 of FIG. 1 depicting especially the relationship of the electrical switch to the interlock plate.
Figure 2:
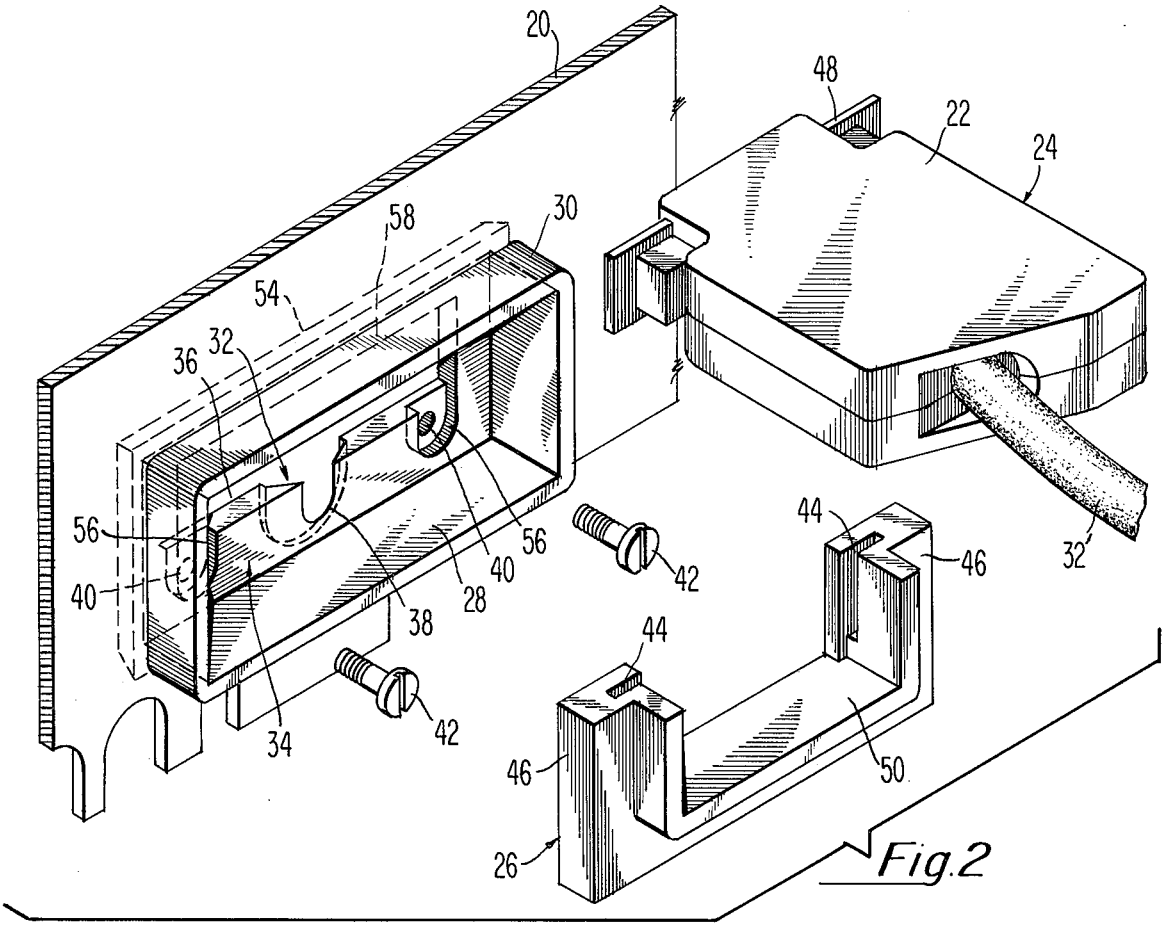
FIG. 2 is an exploded view of the device cover, the cable assembly and interlock plate prior to their being fitted to each other.
Figure 4:
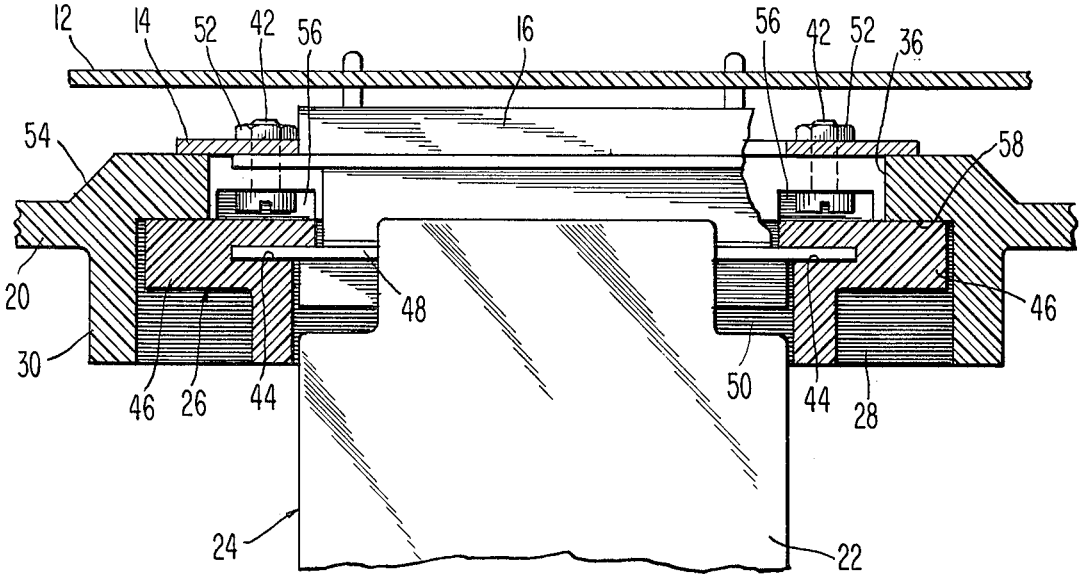
FIG. 4 is a section view taken along the lines 4—4 of FIG. 3 depicting the relationship of the back plane mounting board, the cable assembly with its mating connector, the cover and interlock plate.

With reference to FIG. 2, there is illustrated the cover section 20 of the terminal device 10. Extending outward from the surface of the cover 20, and preferably formed in one piece therewith, is a unitary wall-like structure, whose sides 30 define a generally rectangular box or well 28. The innermost portion of the well is comprised of two adjacent sections 32 and 34. The first section 32 includes a substantially rectangular aperture 36 in the cover wall to permit connector means 22 associated with the cable assembly 24 to be interlocked, to be plugged into the mating connector means 16 situated on the back plane mounting board 14. The other section, 34 which is substantially rectangular in form, is comprised of the same material as the remainder of the cover 20. This second section includes a centrally disposed slot-like aperture 38 which intersects the rectangular aperture 36 of the first section, and is countersunk on its reverse side. Also, the last section includes on either side of aperture 38, openings 40 which are recessed to accommodate the heads of the cover mounting screws 42, as also seen in FIGS. 3 and 4. These screws permit the cover 20 to be fastened to the back plane mounting board 14, and access to the interior of the terminal set cannot be had without the first removal of these screws.

The cable assembly 24 comprises connector plug 22. As illustrated the plug and receptacle may be the well-known type RS 232C interface connector. The interlock plate 26 is a generally "U" shaped member, having a slot 44 in each of its opposite legs 46. In placing the connector plug 22 into the interlock plate 26, the flanges 48 of the connector fit within the respective slots 44, and the body of the connector 22 rests upon the flat surface 50 of the central portion of the plate 26.

With continued general reference to FIG. 2 and particular reference to FIGS. 3 and 4, the terminal device is readied for operation by attaching the rear cover 20 to the mounting board 14. This is accomplished by screws 42 which pass through apertures 40 into captive nuts 52 affixed to the mounting board 14. As seen in FIGS. 3 and 4, and in phantom in FIG. 2, the cover 20 includes on the side of the cover opposite to the well 28, a frame-like projection 54 which permits, after installation, firm contact between the cover 20 and the mounting board 14; shields the connector means 16 and 22; and serves as a spacing element for the proper joinder of the connector means.

When screws 42 are fully advanced, their heads are within the respective recesses 56 associated with apertures 40. This arrangement eliminates any physical interference with the subsequent insertion of the interlock plate 26 and cable assembly 24 into the well 28. With the cover 20 installed, the actuating push button **18*a* of switch 18 protrudes through opening 38** into the well. It may be assumed for purpose of example, that the switch contacts are open circuited at this time.

The flanges 48 of connector 22 are then inserted into the respective slots 44 of the interlock plate 26. The plate 26 and assembly 24 are inserted into the well 28, where the connector portions are joined together. The periphery of the inner surface of the plate 26 now bears against the surface of section 34, and a coplanar ledge 58 as seen in FIG. 2 which surrounds the remaining sides of rectangular opening 36.

At this time, push button **18*a* is depressed by the inner surface of plate 26, as seen in FIG. 3, thereby closing the contacts within switch 18 and establishing an electrical circuit. The latter circuit which includes a source of power permits the insertion and maintenance of secure information and codes into the terminal via additional input means, (not shown). Interruption of this electrical circuit, such as by release of pressure on the push button 18*a*, immediately eradicates all of the information within the terminal 10**.

In conclusion, it is apparent that the interlock system disclosed herein offers an efficient, economical solution to the problem of protecting secure data communication terminals and similar equipments. The inventive concepts and implementation described herein are directed to a specific application. In their applications, changes and modifications of the interlock may be needed to suit particular requirements. Such variations as are within the skill of the designer, and which do not depart from the true scope and spirit of the invention are intended to be covered by the following claims.

What is claimed is:

1. An interlock system for use with a cable assembly in a security-type electronic device comprising:

access cover means, said cover means including a well-like structure having outwardly projecting sides, the innermost portion of said well having two sections, a first of said sections being comprised substantially of a first opening through said cover means, the second of said sections having a second opening and at least one additional recessed opening therein, an interlock plate having a generally "U" shaped configuration, the opposite legs of said plate having respective slotted sections, said cable assembly to be interlocked including connector means, said connector means having oppositely disposed flanges for respective positioning within said slotted sections of said interlock plate, fastener means operative through said recessed opening in said second well section for affixing said cover means to said device, the combined interlock plate/cable assembly being subsequently operatively disposed within said well, said connector means being accessible from within said device through said first opening, said fastener means being obscured from external view by said interlock plate, an electrical switch associated with said device, said switch having actuating means protruding through said second opening, said interlock plate contacting said switch actuating means when operatively disposed within said well and establishing thereby a predetermined electrical condition within said device which permits the input and storage of security-type information, the removal of said interlock plate with its cable assembly terminating said electrical condition, and resulting in the destruction of the stored information.

2. An interlock system as defined in claim 1 further characterized in that said well-like structure is comprised of the same material as said cover means and is formed in one piece therewith.

3. An interlock system as defined in claim 2 further including mounting means internal to said device for supporting a mating connector to be joined with the connector means included in said cable assembly, and for supporting said electrical switch.

4. An interlock system as defined in claim 3 further characterized in that said cover means includes on the side opposite to said well structure, a frame-like projection formed in one piece with said cover means and having a contour substantially similar to that of the periphery of said well, said frame-like projection abutting said mounting means upon operation of said fastener means.

5. An interlock system as defined in claim 4 further including a housing for said device which encloses the top and the sides thereof with the exception of the side enclosed by said access cover means, a pair of tabs formed in said housing and proximately situated at respective side corners which abut said cover means, housing fastener means cooperating with said tabs to secure said housing to said device, said cover means including a pair of inwardly projecting members situated respectively at corners homologous to those of said tab-bearing side corners, said last mentioned members covering said housing fastener means and preventing the removal thereof when said cover means is in place.

6. An interlock system as defined in claim 5 wherein said second opening is centrally located in said second section, and a pair of recessed openings are situated respectively on opposite sides thereof.

7. An interlock system as defined in claim 6 wherein said fastener means are machine screws adapted to engage respective captive nuts on said mounting means.

8. An interlock system as defined in claim 7 wherein said electrical switch is of the push button variety, said second opening accommodating the actuating button of said switch.

9. An interlock system as defined in claim 8 further characterized in that said connector means are of the RS 232C interface type.

* * * * *